US007877956B2

(12) United States Patent
Martensson

(10) Patent No.: US 7,877,956 B2
(45) Date of Patent: Feb. 1, 2011

(54) FLOOR ELEMENT WITH GUIDING MEANS

(75) Inventor: Göran Martensson, Klagstorp (SE)

(73) Assignee: Pergo AG, Baar (CH)

( * ) Notice: Subject to any disclaimer, the term of this patent is extended or adjusted under 35 U.S.C. 154(b) by 1043 days.

(21) Appl. No.: 10/835,542

(22) Filed: Apr. 30, 2004
(Under 37 CFR 1.47)

(65) Prior Publication Data

US 2005/0097860 A1 May 12, 2005

Related U.S. Application Data

(60) Continuation-in-part of application No. 10/019,649, filed as application No. PCT/SE00/001385 on Jun. 30, 2000, now Pat. No. 6,729,091, and a continuation-in-part of application No. 10/158,945, filed on Jun. 3, 2002, now Pat. No. 7,497,058, which is a division of application No. 10/195,408, filed on Dec. 5, 2002, now Pat. No. 6,606,834, which is a continuation of application No. 09/705,916, filed on Nov. 6, 2000, now Pat. No. 6,421,970.

(51) Int. Cl.
*E04B 1/38* (2006.01)
*E04B 5/00* (2006.01)

(52) U.S. Cl. ..... 52/747.1; 52/747.11; 52/747.12; 52/745.2; 52/581; 52/582.1; 52/586.2

(58) Field of Classification Search ..... 52/586.1, 52/586.2, 585.1, 591.2, 591.3, 591.4, 591.5, 52/592.1, 592.2, 384–392, 578–581, 590.1, 52/590.2, 590.3, 582.1, 583.1, 587.1, 589.1, 52/506.06, 506.1, 745.2, 746.1, 747.1, 747.11, 52/747.12, 591.1
See application file for complete search history.

(56) References Cited

U.S. PATENT DOCUMENTS 208,036 A 9/1878 Robley (Continued)

FOREIGN PATENT DOCUMENTS

AT 002214 8/2005

(Continued)

OTHER PUBLICATIONS

Patent Mit Inter-nationalem, Die Revolution ((von Grund auf)) Fibo-Trespo, Disstributed at the Domotex fair in Hannover, Germany in Jan. 1996.

(Continued)

*Primary Examiner*—Jeanette E. Chapman
(74) *Attorney, Agent, or Firm*—Novak Druce & Quigg LLP

(57) ABSTRACT

Floor element (1), which is mainly in the form of a board with triangular, quadratic, rectangular, rhomboidal or polygonal shape as seen from above. The floor element (1) is provided with edges (2), a lower side (7) and a decorative upper layer (3). The floor elements (1), which are intended to be joined via tongue and groove are on at least two opposite edges (2), preferably on all edges (2) provided with holes (4). The holes (4) extends inwards from the edge (2) mainly parallel to the decorative upper layer (3). The holes (4) are arranged on a predetermined distance from the decorative upper layer (3) and on a predetermined distance from a closest corner between two adjacent edges (2), whereby the holes (4) are intended to receive each one part of a guiding means (6).

13 Claims, 6 Drawing Sheets

U.S. PATENT DOCUMENTS

| | | | | | |
|---|---|---|---|---|---|
| 213,740 | A | | 4/1879 | Conner | |
| 308,313 | A | | 11/1884 | Gerike | |
| 662,458 | A | | 11/1900 | Nagel | |
| 714,987 | A | | 12/1902 | Wolfe | |
| 753,791 | A | | 3/1904 | Fulghum | |
| 769,355 | A | | 9/1904 | Platow | |
| 832,003 | A | | 9/1906 | Torrence | |
| 877,639 | A | | 1/1908 | Galbraith | |
| 898,381 | A | | 9/1908 | Mattison | |
| 1,097,986 | A | | 5/1914 | Moritz | |
| 1,124,228 | A | | 1/1915 | Houston | |
| 1,137,197 | A | | 4/1915 | Ellis | |
| 1,140,958 | A | | 5/1915 | Cowan | |
| 1,319,286 | A | | 10/1919 | Johnson et al. | |
| 1,357,713 | A | | 11/1920 | Lane | |
| 1,407,679 | A | | 2/1922 | Ruchrauff | |
| 1,454,250 | A | | 5/1923 | Parsons | |
| 1,468,288 | A | | 9/1923 | Fen | |
| 1,510,924 | A | | 10/1924 | Daniels et al. | |
| 1,540,128 | A | | 6/1925 | Houston | |
| 1,575,821 | A | | 3/1926 | Daniels | |
| 1,602,256 | A | | 10/1926 | Sellin | |
| 1,602,267 | A | | 10/1926 | Karwisde | |
| 1,615,096 | A | | 1/1927 | Myers | |
| 1,622,103 | A | | 3/1927 | Fulton | |
| 1,622,104 | A | | 3/1927 | Fulton | |
| 1,637,634 | A | | 8/1927 | Carter | |
| 1,644,710 | A | | 10/1927 | Crooks | |
| 1,660,480 | A | | 2/1928 | Daniels | |
| 1,714,738 | A | | 5/1929 | Smith | |
| 1,718,702 | A | | 6/1929 | Pfiester | |
| 1,734,826 | A | | 11/1929 | Pick | |
| 1,764,331 | A | | 6/1930 | Moratz | |
| 1,772,417 | A | | 8/1930 | Ellinwood | |
| 1,776,188 | A | | 9/1930 | Langbaum | |
| 1,778,069 | A | | 10/1930 | Fetz | |
| 1,787,027 | A | | 12/1930 | Wasleff | |
| 1,823,039 | A | | 9/1931 | Gruner | |
| 1,843,024 | A | * | 1/1932 | Werner | 52/591.1 |
| 1,854,396 | A | | 4/1932 | Davis | |
| 1,859,667 | A | | 5/1932 | Gruner | |
| 1,898,364 | A | | 2/1933 | Gynn | |
| 1,906,411 | A | | 4/1933 | Potvin | |
| 1,913,342 | A | | 6/1933 | Schaffert | |
| 1,929,871 | A | | 10/1933 | Jones | |
| 1,940,377 | A | | 12/1933 | Storm | |
| 2,044,216 | A | | 1/1934 | Klages | |
| 1,953,306 | A | | 4/1934 | Moratz | |
| 1,978,075 | A | * | 10/1934 | Butterworth | 52/506.01 |
| 1,986,739 | A | | 1/1935 | Mitte | |
| 1,988,201 | A | | 1/1935 | Hall | |
| 1,991,701 | A | | 2/1935 | Roman | |
| 2,004,193 | A | | 6/1935 | Cherry | |
| 2,015,813 | A | | 10/1935 | Nielsen | |
| 2,027,292 | A | | 1/1936 | Rockwell | |
| 2,045,067 | A | | 6/1936 | Bruce | |
| 2,049,571 | A | | 8/1936 | Schuck | |
| 2,100,238 | A | | 11/1937 | Burgess | |
| 2,138,085 | A | * | 11/1938 | Birtles | 52/127.12 |
| 2,141,708 | A | | 12/1938 | Elmendorf | |
| 2,142,305 | A | | 1/1939 | Davis | |
| 1,706,924 | A | | 3/1939 | Kane | |
| 2,194,086 | A | | 3/1940 | Horn | |
| 2,199,938 | A | | 5/1940 | Kloote | |
| 2,222,137 | A | | 11/1940 | Bruce | |
| 2,245,497 | A | | 6/1941 | Potchen | |
| 2,266,464 | A | * | 12/1941 | Kraft | 52/586.2 |
| 2,276,071 | A | | 3/1942 | Scull | |
| 2,282,559 | A | | 5/1942 | Byers | |
| 2,324,628 | A | | 7/1943 | Kahr | |
| 2,363,429 | A | | 11/1944 | Lowry | |
| 2,398,632 | A | | 4/1946 | Frost et al. | |
| 2,430,200 | A | | 11/1947 | Wilson | |
| 2,491,498 | A | | 12/1949 | Kahr | |
| 2,729,584 | A | | 1/1956 | Foster | |
| 2,740,167 | A | | 4/1956 | Rowley | |
| 2,780,253 | A | | 2/1957 | Joa | |
| 2,808,624 | A | | 10/1957 | Sullivan | |
| 2,831,223 | A | | 4/1958 | DeShazor | |
| 2,894,292 | A | | 7/1959 | Gramelspacher | |
| 2,952,341 | A | | 9/1960 | Weller | |
| 2,996,751 | A | | 8/1961 | Roby | |
| 3,045,294 | A | | 7/1962 | Livezey, Jr. | |
| 3,090,082 | A | | 5/1963 | Bauman | |
| 3,100,556 | A | | 8/1963 | Ridder | |
| 3,125,138 | A | | 3/1964 | Bolenbach | |
| 3,128,851 | A | | 4/1964 | Deridider et al | |
| 3,141,392 | A | | 7/1964 | Schneider | |
| 3,148,482 | A | * | 9/1964 | Neale | 52/390 |
| 3,162,906 | A | | 12/1964 | Dudley | |
| 3,182,769 | A | | 5/1965 | de Ridder | |
| 3,199,258 | A | | 8/1965 | Jentoft | |
| 3,203,149 | A | | 8/1965 | Soddy | |
| 3,253,377 | A | | 5/1966 | Schakel | |
| 3,267,630 | A | | 8/1966 | Omholt | |
| 3,282,010 | A | | 11/1966 | King, Jr. | |
| 3,286,425 | A | | 11/1966 | Brown | |
| 3,310,919 | A | | 3/1967 | Bue et al. | |
| 3,331,171 | A | | 7/1967 | Hallock | |
| 3,347,048 | A | | 10/1967 | Brown et al. | |
| 3,362,127 | A | | 1/1968 | McGowan | |
| 3,363,382 | A | | 1/1968 | Forrest | |
| 3,373,071 | A | | 3/1968 | Fuerst | |
| 3,387,422 | A | | 6/1968 | Wanzer | |
| 3,460,304 | A | | 8/1969 | Braeuninger et al. | |
| 3,473,278 | A | | 10/1969 | Gossen | |
| 3,479,784 | A | | 11/1969 | Massagli | |
| 3,481,810 | A | | 12/1969 | Waite | |
| 3,488,828 | A | | 1/1970 | Gallagher | |
| 3,508,369 | A | | 4/1970 | Tennison | |
| 3,526,420 | A | | 9/1970 | Brancaleone | |
| 3,535,844 | A | | 10/1970 | Glaros | |
| 3,538,665 | A | | 11/1970 | Gohner | |
| 3,538,819 | A | | 11/1970 | Gould at al. | |
| 3,553,919 | A | | 1/1971 | Omholt | |
| 3,555,762 | A | | 1/1971 | Costanzo, Jr. | |
| 3,570,205 | A | | 3/1971 | Payne | |
| 3,657,852 | A | | 4/1972 | Worthington et al. | |
| 3,665,666 | A | | 5/1972 | Delcroix | |
| 3,671,369 | A | | 6/1972 | Kvalheim et al. | |
| 3,687,773 | A | * | 8/1972 | Wangborg | 156/265 |
| 3,694,983 | A | | 10/1972 | Couquet | |
| 3,696,575 | A | | 10/1972 | Armstrong | |
| 3,714,747 | A | | 2/1973 | Curran | |
| 3,720,027 | A | | 3/1973 | Christensen | |
| 3,731,445 | A | | 5/1973 | Hoffmann et al. | |
| 2,644,552 | A | | 7/1973 | MacDonald | |
| 3,745,726 | A | | 7/1973 | Thom | |
| 3,759,007 | A | | 9/1973 | Thiele | |
| 3,760,544 | A | | 9/1973 | Hawes | |
| 3,768,846 | A | | 10/1973 | Hensley et al. | |
| 3,778,958 | A | | 12/1973 | Fowler | |
| 3,798,111 | A | | 3/1974 | Lana et al. | |
| 3,807,113 | A | | 4/1974 | Turner | |
| 3,810,707 | A | | 5/1974 | Tungseth | |
| 3,859,000 | A | | 1/1975 | Webster | |
| 3,884,328 | A | | 5/1975 | Williams | |
| 3,902,293 | A | | 9/1975 | Witt et al. | |
| 3,908,053 | A | | 9/1975 | Hettich | |
| 3,921,312 | A | | 11/1975 | Fuller | |
| 3,936,551 | A | | 2/1976 | Elmendorf et al. | |
| 3,988,187 | A | | 10/1976 | Witt et al. | |
| 4,067,155 | A | | 1/1978 | Ruff | |
| 4,074,496 | A | | 2/1978 | Fischer | |

4,090,338 A 5/1978 Bourgade
4,099,358 A 7/1978 Compaan
4,158,335 A 6/1979 Belcastro
4,169,688 A 10/1979 Toshio
4,186,539 A 2/1980 Harmon et al.
4,198,455 A 4/1980 Spiro et al.
4,242,390 A 12/1980 Nemeth
4,292,774 A 10/1981 Mairle
4,299,070 A 11/1981 Oltmanns et al.
4,316,351 A 2/1982 Ting
4,390,580 A 6/1983 Donovan et al.
4,426,820 A 1/1984 Terbrack et al.
4,449,346 A 5/1984 Tremblay
4,455,803 A 6/1984 Kornberger
4,461,131 A 7/1984 Pressel
4,471,012 A 9/1984 Maxwell
4,501,102 A 2/1985 Knowles
4,504,347 A 3/1985 Munk et al.
4,561,233 A 12/1985 Harter et al.
4,571,910 A 2/1986 Cosentino
4,612,745 A 9/1986 Hovde
4,641,469 A 2/1987 Wood
4,643,237 A 2/1987 Rosa
4,653,242 A 3/1987 Ezard
4,703,597 A 11/1987 Eggemar
4,715,162 A 12/1987 Brightwell
4,733,510 A 3/1988 Werner
4,736,563 A 4/1988 Bilhorn
4,738,071 A 4/1988 Ezard
4,757,658 A 7/1988 Kaempen
4,769,963 A 9/1988 Meyerson
4,796,402 A 1/1989 Pajala
4,819,932 A 4/1989 Trotter, Jr.
4,831,806 A 5/1989 Niese et al.
4,845,907 A 7/1989 Meek
4,893,449 A 1/1990 Kemper
4,905,442 A 3/1990 Daniels
4,940,503 A 7/1990 Lindgren et al.
5,029,425 A 7/1991 Bogataj
5,034,272 A 7/1991 Lindgren et al.
5,050,362 A 9/1991 Tal et al.
5,074,089 A 12/1991 Kemmer
5,086,599 A 2/1992 Meyerson
5,113,632 A 5/1992 Hanson
5,117,603 A 6/1992 Weintraub
5,148,850 A 9/1992 Urbanick
5,155,952 A 10/1992 Herwegh
5,165,816 A 11/1992 Parasin
5,179,812 A 1/1993 Hill
5,216,861 A 6/1993 Meyerson
5,244,303 A * 9/1993 Hair ..... 404/41
5,247,773 A * 9/1993 Weir ..... 52/592.3
5,253,464 A 10/1993 Nilsen
5,259,162 A 11/1993 Nicholas
5,271,564 A 12/1993 Smith
5,274,979 A 1/1994 Tsai
5,295,341 A * 3/1994 Kajiwara ..... 52/586.2
5,325,649 A 7/1994 Kajiwara
5,344,700 A 9/1994 McGath et al.
5,348,778 A 9/1994 Knipp et al.
5,349,796 A 9/1994 Meyerson
5,365,713 A 11/1994 Nicholas
5,390,457 A 2/1995 Sjolander
5,433,806 A 7/1995 Pasquali et al.
5,474,831 A 12/1995 Nystrom
5,497,589 A 3/1996 Porter
5,502,939 A * 4/1996 Zadok et al. ..... 52/309.9
5,540,025 A 7/1996 Takehara et al.
5,567,497 A 10/1996 Zegler et al.
5,570,554 A 11/1996 Searer
5,581,967 A 12/1996 Glatz
5,597,024 A 1/1997 Bolyard et al.
5,618,602 A 4/1997 Nelson
5,618,612 A 4/1997 Gstrein
5,623,799 A 4/1997 Kowalski
5,630,304 A 5/1997 Austin
5,657,598 A 8/1997 Wilbs
5,671,575 A 9/1997 Wu
5,706,621 A 1/1998 Pervan
5,719,239 A 2/1998 Mirous et al.
5,736,227 A 4/1998 Sweet et al.
5,797,237 A 8/1998 Finkell, Jr.
5,823,240 A 10/1998 Bolyard et al.
5,827,592 A 10/1998 Van Gulik et al.
5,860,267 A 1/1999 Pervan
5,888,017 A 3/1999 Corrie
5,904,019 A 5/1999 Kooij et al.
5,907,934 A 6/1999 Austin
5,935,668 A 8/1999 Smith
5,941,047 A 8/1999 Johansson
5,943,239 A 8/1999 Shamblin et al.
5,945,181 A * 8/1999 Fisher ..... 428/33
5,968,625 A 10/1999 Hudson
5,987,839 A 11/1999 Hamar et al.
5,987,845 A 11/1999 Laronde
6,006,486 A * 12/1999 Moriau et al. ..... 52/589.1
6,021,615 A 2/2000 Brown
6,023,907 A 2/2000 Pervan
6,029,416 A 2/2000 Andersson
6,094,882 A 8/2000 Pervan
6,101,778 A 8/2000 Martensson
6,119,423 A 9/2000 Costantino
6,134,854 A 10/2000 Stanchfield
6,141,920 A 11/2000 Kemper
6,148,884 A 11/2000 Bolyard et al.
6,158,915 A 12/2000 Kise
6,182,410 B1 2/2001 Pervan
6,182,413 B1 2/2001 Magnusson
6,189,283 B1 2/2001 Bentley
6,205,639 B1 3/2001 Pervan
6,209,278 B1 4/2001 Tychsen
6,216,403 B1 4/2001 Belbeoc'h
6,216,409 B1 * 4/2001 Roy et al. ..... 52/589.1
6,219,982 B1 4/2001 Eyring
6,230,385 B1 5/2001 Nelson
6,253,514 B1 7/2001 Jobe
6,314,701 B1 11/2001 Meyerson
6,324,803 B1 12/2001 Pervan
6,324,809 B1 12/2001 Nelson
6,332,733 B1 12/2001 Hamberger et al.
6,345,480 B1 2/2002 Kemper
6,345,481 B1 2/2002 Nelson
6,365,258 B1 4/2002 Alm
6,385,936 B1 5/2002 Schneider
6,397,547 B1 6/2002 Martensson
6,418,683 B1 7/2002 Martensson et al.
6,421,970 B1 7/2002 Martensson et al.
6,438,919 B1 8/2002 Kauseder
6,446,405 B1 9/2002 Pervan
6,510,665 B2 1/2003 Pervan
6,516,579 B1 2/2003 Pervan
6,517,935 B1 2/2003 Kornfalt et al.
6,532,709 B2 3/2003 Pervan
6,550,205 B2 4/2003 Neuhofer
6,588,165 B1 7/2003 Wright
6,588,166 B2 7/2003 Martensson
6,606,834 B2 8/2003 Martensson
6,729,091 B1 5/2004 Martensson
2001/0029720 A1 10/2001 Pervan
2002/0007608 A1 1/2002 Pervan
2002/0046528 A1 4/2002 Pervan et al.
2002/0095895 A1 7/2002 Daly et al.
2002/0100242 A1 8/2002 Olofsson
2002/0112433 A1 8/2002 Pervan
2002/0127374 A1 9/2002 Spratling
2002/0178573 A1 12/2002 Pervan

| | | | | |
|---|---|---|---|---|
| 2002/0178674 | A1 | 12/2002 | Pervan | |
| 2002/0178682 | A1 | 12/2002 | Pervan | |
| 2003/0009972 | A1 | 1/2003 | Pervan et al. | |
| 2003/0024199 | A1 | 2/2003 | Pervan et al. | |
| 2003/0033784 | A1 | 2/2003 | Pervan | |
| 2003/0084634 | A1 | 5/2003 | Stanchfield | |
| 2003/0084636 | A1 | 5/2003 | Pervan | |
| 2003/0154678 | A1 | 8/2003 | Stanchfield | |
| 2004/0191461 | A1* | 9/2004 | Riccobene | 428/44 |

FOREIGN PATENT DOCUMENTS

| | | | |
|---|---|---|---|
| AU | 199732569 | | 12/1999 |
| AU | 200020703 | | 6/2000 |
| BE | 417526 | | 12/1936 |
| BE | 557844 | | 3/1960 |
| BE | 1010339 | | 6/1998 |
| BE | 1010487 | | 10/1998 |
| CA | 991373 | | 6/1976 |
| CA | 1169106 | | 6/1984 |
| CA | 2226286 | | 12/1997 |
| CA | 2252791 | | 11/1998 |
| CA | 2289309 | | 11/1999 |
| CH | 200949 | | 1/1939 |
| CH | 211877 | | 1/1941 |
| DE | 1212275 | | 3/1966 |
| DE | 1534802 | | 4/1970 |
| DE | 7102476 | | 6/1971 |
| DE | 2159042 | | 11/1971 |
| DE | 2101782 | | 7/1972 |
| DE | 2159042 | | 6/1973 |
| DE | 2238660 | | 2/1974 |
| DE | 7402354 | | 5/1974 |
| DE | 2502992 | | 7/1976 |
| DE | 2616077 | | 10/1977 |
| DE | 2917025 | | 11/1980 |
| DE | 31 04 519 | | 2/1981 |
| DE | 3041781 | | 6/1982 |
| DE | 3214207 | | 11/1982 |
| DE | 3306609 | | 9/1984 |
| DE | 3343601 | | 6/1985 |
| DE | 8604004 | | 4/1986 |
| DE | 3512204 | | 10/1986 |
| DE | 3246376 | | 2/1987 |
| DE | 3246376 | | 5/1987 |
| DE | 3544845 | | 6/1987 |
| DE | 3343601 | | 12/1987 |
| DE | 3631390 | | 12/1987 |
| DE | 3640822 | | 6/1988 |
| DE | 8600241 | | 4/1989 |
| DE | 4002547-0 | | 8/1991 |
| DE | 4134452 | | 4/1993 |
| DE | 4215273 | | 11/1993 |
| DE | 9317191 | | 11/1993 |
| DE | 4242530 | A1 | 6/1994 |
| DE | 1534278 | | 2/1996 |
| DE | 29710175 | U1 | 8/1997 |
| DE | 29711960 | | 10/1997 |
| DE | 19651149 | | 6/1998 |
| DE | 19709641 | | 9/1998 |
| DE | 20001225 | | 7/2000 |
| DE | 19925248 | | 12/2000 |
| DE | 20018284 | | 1/2001 |
| DE | 20017461 | | 2/2001 |
| DE | 20027461 | | 3/2001 |
| DE | 10062873 | A1 * | 7/2002 |
| EP | 0248127 | | 12/1987 |
| EP | 0 220 389 | B1 | 5/1992 |
| EP | 0623724 | | 11/1994 |
| EP | 0652340 | | 5/1995 |
| EP | 0698162 | | 2/1996 |
| EP | 000711886 | | 5/1996 |
| EP | 0843763 | | 5/1998 |
| EP | 0849416 | | 6/1998 |
| EP | 0903451 | | 3/1999 |
| EP | 0855482 | | 12/1999 |
| EP | 0877130 | | 1/2000 |
| EP | 0958441 | | 1/2000 |
| EP | 0974713 | | 1/2000 |
| EP | A20969164 | | 1/2000 |
| EP | A30969163 | | 2/2000 |
| EP | A30969164 | | 2/2000 |
| FI | 843060 | | 8/1984 |
| FR | 557844 | | 8/1923 |
| FR | 1215852 | | 4/1960 |
| FR | 1293043 | | 3/1961 |
| FR | 1293043 | | 5/1962 |
| FR | 2568295 | | 1/1986 |
| FR | 2630149 | | 10/1989 |
| FR | 2637932 | | 4/1990 |
| FR | 2675174 | | 10/1992 |
| FR | 2691491 | | 11/1993 |
| FR | 2691691 | | 11/1993 |
| FR | 2697275 | | 4/1994 |
| FR | 2712329 | | 5/1995 |
| FR | 2781513 | | 1/2000 |
| FR | 2785633 | | 5/2000 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1212983 | | 11/1970 |
| GB | 1237744 | | 6/1971 |
| GB | 1348272 | | 3/1974 |
| GB | 1430423 | | 3/1976 |
| GB | 2117813 | | 10/1983 |
| GB | 2126106 | | 3/1984 |
| GB | 2142670 | A | 1/1985 |
| GB | 2168732 | A | 6/1986 |
| GB | 2243381 | | 10/1991 |
| GB | 2256023 | | 11/1992 |
| IT | 812671 | | 4/1959 |
| JP | 5465528 | | 5/1979 |
| JP | 57119056 | | 7/1982 |
| JP | 3169967 | | 7/1991 |
| JP | 4106264 | | 4/1992 |
| JP | 4191001 | | 7/1992 |
| JP | 5148984 | | 6/1993 |
| JP | 6-146553 | | 5/1994 |
| JP | 6146553 | | 5/1994 |
| JP | 656310 | | 8/1994 |
| JP | 6320510 | | 11/1994 |
| JP | 752103 | | 2/1995 |
| JP | 7076923 | | 3/1995 |
| JP | 7180333 | | 7/1995 |
| JP | 7300979 | | 11/1995 |
| JP | 7310426 | | 11/1995 |
| NL | 7601773 | | 2/1975 |
| NO | 157871 | | 7/1984 |
| NO | 305614 | | 5/1995 |
| PL | 26931 | | 11/1974 |
| RU | 363795 | | 11/1973 |
| SE | 372051 | | 12/1974 |
| SE | 7114900-9 | | 12/1974 |
| SE | 450141 | | 6/1987 |
| SE | 8206934-5 | | 6/1987 |
| SE | 457737 | | 1/1989 |
| SE | 501014 | | 10/1994 |
| SE | 9301595-6 | | 2/1995 |
| SE | 502994 | | 3/1996 |
| SE | 509059 | | 11/1998 |
| SE | 509060 | | 11/1998 |
| SE | 512290 | | 2/2000 |
| SE | 512313 | | 2/2000 |
| WO | WO 80/02155 | | 10/1980 |

| | | |
|---|---|---|
| WO | WO 84/02155 | 6/1984 |
| WO | 8402155 | 6/1985 |
| WO | 8703839 | 7/1987 |
| WO | 9217657 | 10/1992 |
| WO | 9313280 | 7/1993 |
| WO | WO 93/13280 | 7/1993 |
| WO | 9401628 | 1/1994 |
| WO | 9426999 | 11/1994 |
| WO | 9623942 | 8/1996 |
| WO | 9627719 | 9/1996 |
| WO | 9627721 | 9/1996 |
| WO | 9630177 | 10/1996 |
| WO | 9747834 | 12/1997 |
| WO | 9822678 | 5/1998 |
| WO | 9824994 | 6/1998 |
| WO | 9824995 | 6/1998 |
| WO | 9858142 | 12/1998 |
| WO | 9901628 | 1/1999 |
| WO | 9940273 | 8/1999 |
| WO | 9966151 | 12/1999 |
| WO | 9966152 | 12/1999 |
| WO | 0006854 | 2/2000 |
| WO | 0056802 | 9/2000 |
| WO | 0063510 | 10/2000 |
| WO | 0066856 | 11/2000 |
| WO | 0002214 | 3/2001 |
| WO | 0120101 | 3/2001 |

OTHER PUBLICATIONS

Traindustrins Handbok "Snickeriarbete", Knut Larsson, Tekno's Handbocker Publikation 12-11 (1952).
Trabearbetning Anders Gronlund, TrateknikCentrum.
Bojlesystemet til Junckers boliggulve, Junckers Trae for Livet.
The Clip System for Junckers Sports Floors, Junckers Solid Hardood Flooring, Annex 7, p. ½.
The Clip System for Junckers Domestic Floors, Junckers Solid Hardwood Flooring, Annex 8, p. ¼.
Focus, Information Till Alla Medabetare, Jan. 2001, Kahrs pa Domotex i Hannover, Tyskland, Jan. 13-16, 2001.
Opplaering OG Autorisasjon, Fibo-Trespo, ALLOC, Laminatgulvet som Legges Uten Lim.
CLIC, Art-Nr. 110 11 640.
Laminat-Boden, Clever-Clickq.
Pergo, Clic Flooring, Laminatgolv.
Letter to the USPTO dated May 14, 2002, regarding U.S. Appl. No. 90/005,744.
Webster's Dictionary, p. 862, definition of "scarf".
Knight's American Mechanical Dictionary, vol. III, 1876, definition of "scarf".
U.S. Appl. No. 10/149,679, Jun. 2002.
Search Report dated Apr. 21, 2001.
Fiboloc Literature, Mar. 1999.
Fiboloc Brochure (undated).
Appeals from the United States District Court for the Eastern District of Wisconsin; Consolidated case No. 02-CV-0736 and 03-CV-616; Judge J.P. Stadtmueller; 2009-1107,-1122.
Appeals from the United States District Court for the Eastern District of Wisconsin; Consolidated case No. 02-CV-0736 and 03-CV-616; 2009-1107,-1122; Revised Feb. 25, 2010.
United States District Court North Carolina; *Pergo* (*Europe*) *AB* v *Unilin Beheer BV*. Civil Action No. 5:08-CV-91; Joint Stipulation of Dismissal.
United States District Court of North Carolina; *Pergo* (*Europe*) *AB* v *Unilin Beheer BV*. Civil Action No. 5:08-CV-91-H3; Plantiff's Original Complaint for Patent Infringement.
United States District Court of North Carolina; *Pergo* (*Europe*) *AB* v *Unilin Beheer BV*. Civil Action No. 5:08-CV-91-H3; Answer and Counterclaim of Defendant.
United States Court of Appeals fo the Federal Circuit; Case No. 02-CV-0736 and 03-CV-616; Mandate issued on Apr. 12, 2010; Judgment; 2 pages.
Fundamentals of Building Construction Materials and Methods; Copyright 1985; pp. 11.
Automated Program fo Designing Snap-fits; Aug. 1987; pp. 3.
Plastic Product Design; Van Nostrand Reinhold Company; pp. 256-258.
Traditional Details; For Building Resoration, Renovation, and Rehabilitation; From the 1932-1951 Editions of Architectvral Graphic Standards; John Wiley & Sons, Inc.
Whittington's Dictionary of Plastics; Edited by James F. Carley, Ph.D., PE; pp. 443, 461; 1993.
Encyclopedia of Wood Joints; A Fine Woodworking Book; pp. 1-151; 1992.
High-Production Roll Forming; Society of Manufacturing Engineers Marketing Services Department; pp. 189-192; George T. Halmos; 1983.
Knight's American Mechanical Dictionary; 3 Edward H. Knight; vol. Ill; p. 2051; 1876.
Plastic Part Technology; Copy 1991; pp. 161-162.
New Software Simplifies Snap-Fit Design; Design News; p. 148.
Hot Rolling of Steel; Library of Congress Cataloging in Publication Data; Roberts, William L; p. 189.
Technoscope; Modern Plastics, Aug. 1991; pp. 29-30.
Die mobile; Terbrack; 1968.
Trae Pjecer; pp. 1-35.
Elements of Rolling Practice; The United Steel Companies Limited Sheffield, England, 1963; pp. 116-117.

* cited by examiner

FIG. 4
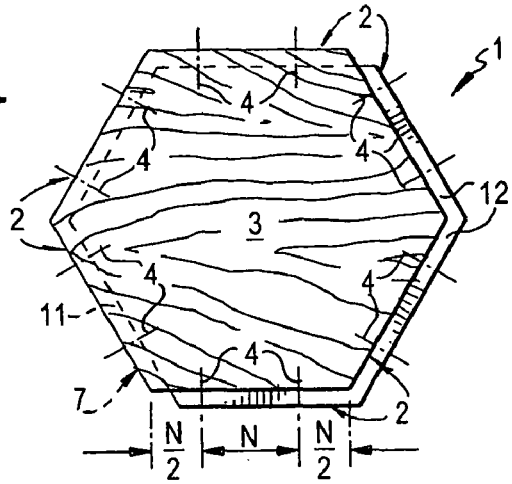
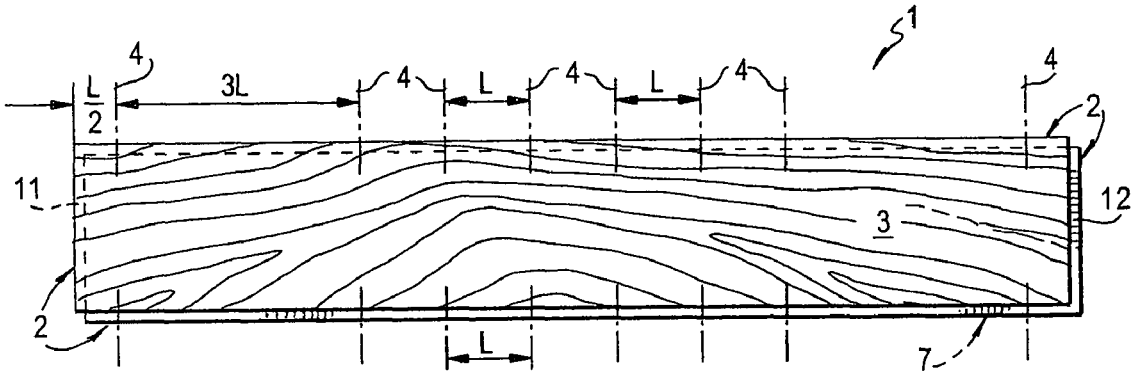
FIG. 5
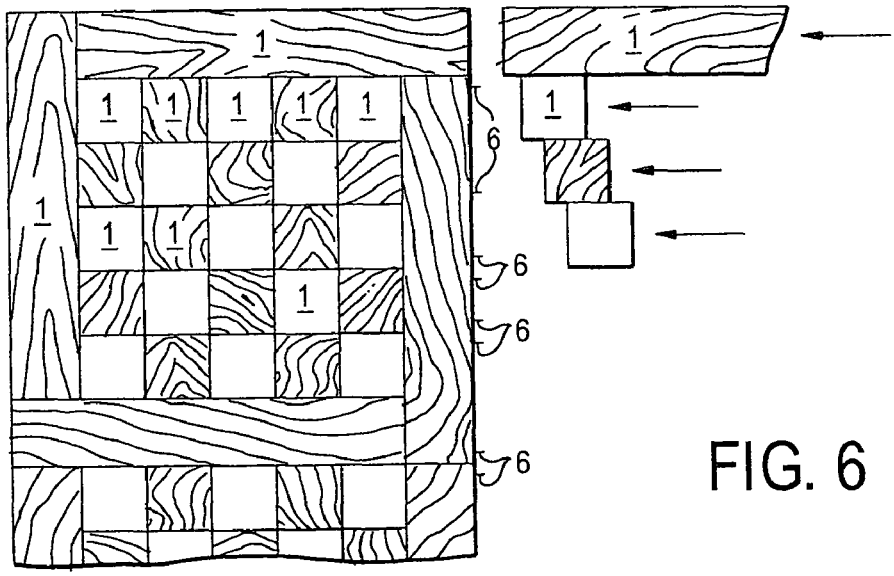
FIG. 6

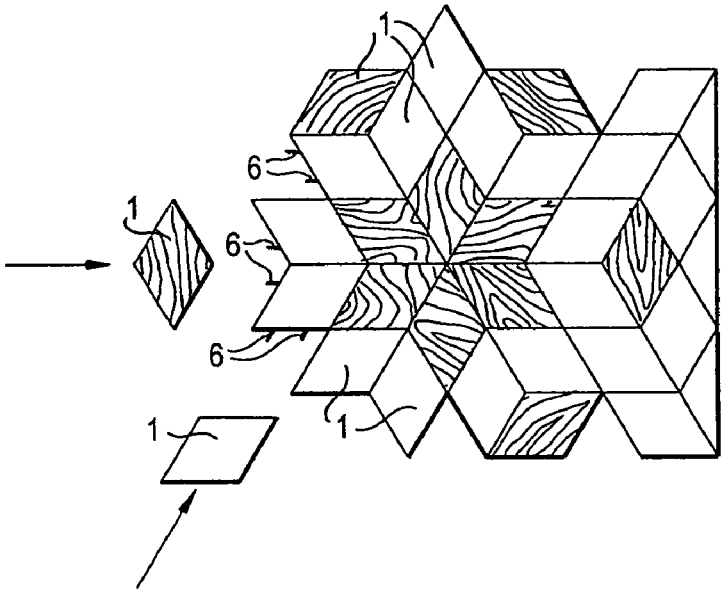
FIG. 10
FIG. 11
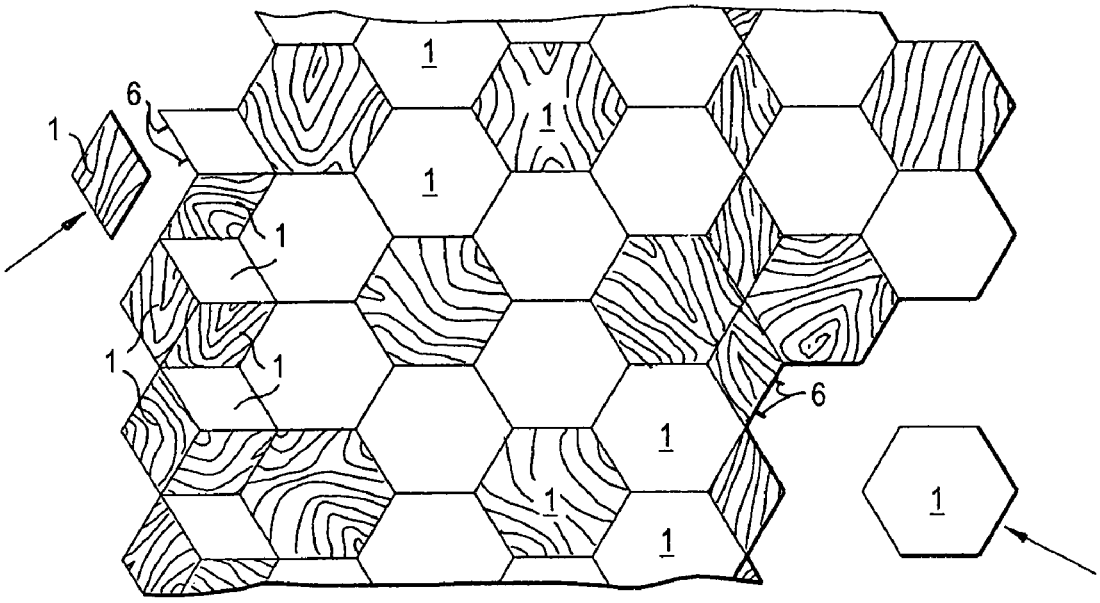
FIG. 12
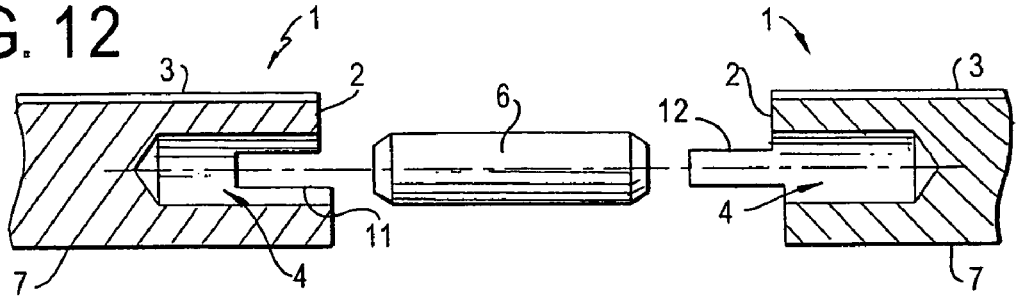

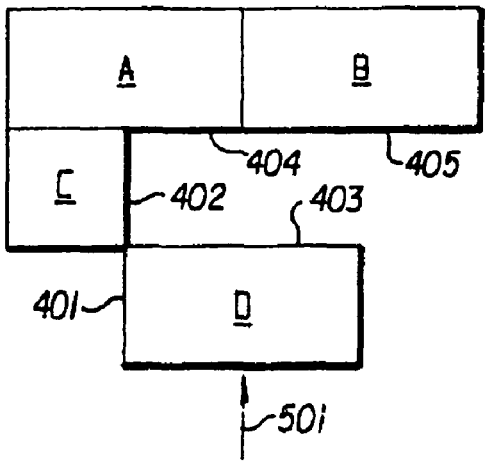
FIG. 16
FIG. 17
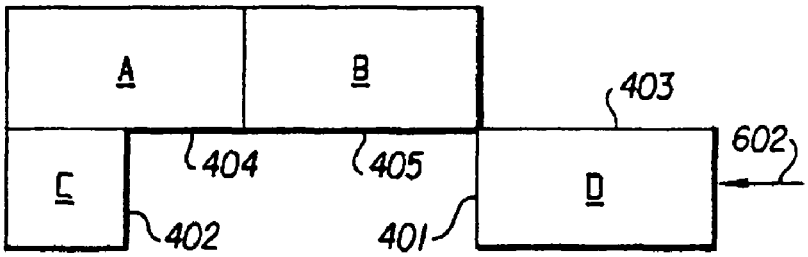
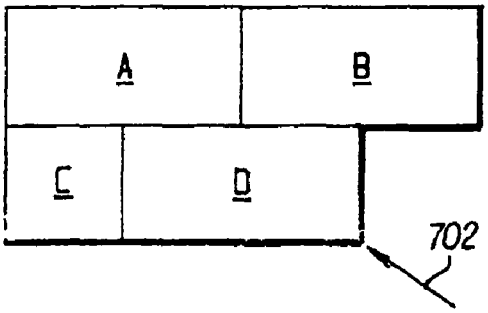
FIG. 18
FIG. 19
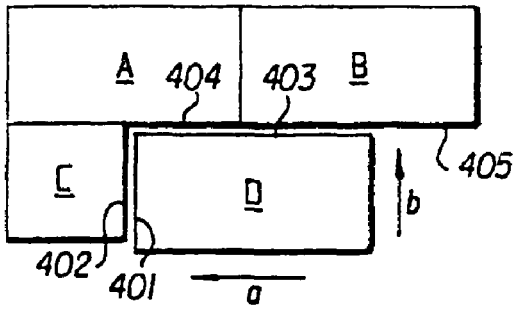

FLOOR ELEMENT WITH GUIDING MEANS

CROSS REFERENCE TO RELATED APPLICATIONS

This application is a C-I-P of U.S. application Ser. No. 10/019,649, filed Feb. 22, 2002, now U.S. Pat. No. 6,729,091, which is a 35 USC 371 National Phase of PCT/SE2000/01385 filed Jun. 30, 2000; and a continuation-in-part of U.S. application Ser. No. 10/158,945, filed Jun. 3, 2002, and a continuation-in-part of U.S. application Ser. No. 10/642,139, filed Aug. 18, 2003, now U.S. Pat. No. 7,131,242 which is a division of U.S. application Ser. No. 10/195,408, filed. Jul. 16, 2002, now U.S. Pat. No. 6,606,834, which is a continuation of U.S. application Ser. No. 09/705,916, filed Nov. 6, 2000, now U.S. Pat. No. 6, 421,970, each of which is incorporated herein in its entirety.

BACKGROUND

1. Field of the Invention

The present invention relates to floor elements which are joined by means of tongue, groove and separate guiding means.

2. Description of the Related Arts

Prefabricated board shaped floor elements which are provided with tongue and groove at the edges are common nowadays. They are very easy to install whereby this can be accomplished by the average handy man. Such floor elements can, for example, be made of solid wood, fibre board or particle board. These are most often provided with a surface layer such as a lacquer or some type of laminate.

The boards are most often installed by being glued together via tongue and groove.

This type of floor is usually installed so that the boards overlap and the latitudinal joint do not coincide. It has therefore not been any reason to guide the relative longitudinal position between the boards. Designed installations is very difficult to achieve without this possibility. One example where it should be desirable to have coinciding latitudinal as well as longitudinal joint is completely quadratic or square floor elements. This is very difficult as scales or a very sure eye and great workman skills is required if a successful end result is to be achieved. It is furthermore very easy to dislodge already installed floor elements when installing new ones. It is also sometimes desired to have latitudinal joints coincide over, for example, every other or every third latitudinal joint, when installing with overlap.

This requirement is foremost present when floor boards with dissimilar decor is used for creating a decorative effect on larger floor surfaces. This requirement goes for quadratic as well as rectangular floor elements.

SUMMARY OF THE INVENTION

It has, through the present invention, been made possible to solve the above mentioned problems, whereby a designed floor installation, even with complex patterns, easily can be installed with great accuracy, even by the average handyman. Thus, the invention relates to floor elements which are mainly in the form of boards with triangular, quadratic, rectangular, rhomboidal or polygonal shape as seen from above. The floor elements are provided with edges, a lower side and a decorative upper layer. The floor elements are intended to be joined by means of tongue and groove. The invention is characterised in that the floor elements are provided, in one embodiment, with holes in at least two opposite edges, preferably all four edges, which holes extends inwards from the edge mainly parallel with the upper layer. The holes are arranged at a predetermined distance from the upper decorative layer and at a predetermined distance from the closest edge between two adjacent edges. The holes are intended to receive one part of a guiding means each.

The holes preferably extend perpendicular to the edge where the holes are arranged. Alternatively, the holes extend parallel to the edge which is adjacent to the edge where the holes are arranged. In cases where the corners of the floor boards are right-angled the holes preferably extends perpendicular to the edge where they are arranged and parallel to the edge which is adjacent to the edge where they are arranged.

According to one embodiment of the invention, the floor element has four edges with the same length. Each edge is suitably provided with each one hole group of two holes. The holes have, in each hole group, been arranged on a mutual distance of N from each other and that the distance between a hole and its closest edge is N/2, whereby the length of the edge is 2N.

According to a second embodiment of the invention the floor element has two opposite edges with larger length than the two remaining edges. The two shorter edges are suitably provided with each one hole group of two holes. The holes have, in each hole group, been arranged on a mutual distance of N from each other and that the distance between a hole and its closest edge is N/2, whereby the length of the edge is 2N. The two long side edges are provided with each one hole group of three or more holes of which the outermost are arranged on a distance of L/2 from the closest edge while the distance between two adjacent holes arranged on the long sides is L, whereby the length of the long side edge is an integer larger than 3L, preferably smaller than 30L.

The two long side edges are alternatively provided with each one hole group of three or more holes, of which the outermost holes are arranged on a distance of L/2 from the respective closest corner between two adjacent edges. The distance between two adjacent holes arranged on the long side edge is L, 2L, 3L, 4L, 5L or combinations thereof. The length L is in both cases suitably equal to the length N.

The holes are suitably provided with an inner, gripping edge. The holes are thereby suitably provided with an inner gripping edge by milling a groove from the lower side. This groove is then suitably perpendicular to the hole and thereby parallel to the edge where the hole, which is intersected by the groove, is arranged. The hole may alternatively be provided with an inner gripping edge by milling a step with larger diameter than the hole, on a predetermined depth.

The guiding means are then suitably provided with each two ends which each are provided with one or more resilient projections. These projections are intended to interact with the gripping edges of the holes.

BRIEF DESCRIPTION OF THE DRAWINGS

The invention is further illustrated by means of enclosed figures showing different embodiments of a flooring material according to the present invention whereby.

FIG. 4 shows, seen from above, yet another embodiment of a floor element 1 with a hexagonal surface.

FIG. 5 shows, seen from above, yet another embodiment of a floor element 1 with a rectangular surface.

FIG. 6 shows, seen from above an embodiment of the invention where quadratic floor elements 1 according to FIG. 1 and rectangular floor elements 1 according to FIG. 5 together form a so-called designed installation.

FIG. 10 shows, seen from above, an embodiment where rhomboidal floor elements according to FIG. 2 form a so-called designed installation.

FIG. 11 shows, seen from above, an embodiment of the invention where rhomboidal floor elements according to FIG. 2 and hexagonal floor elements according to FIG. 4 together form a so-called designed installation.

FIG. 12 shows, in cross-section, parts of two floor elements 1 and a guiding means 6 according to one embodiment of the invention.

FIGS. 16-19 disclose various methods of assembling the panels into a finished structure, such as a floor.

DETAILED DESCRIPTION OF THE INVENTION

Figure 1A:
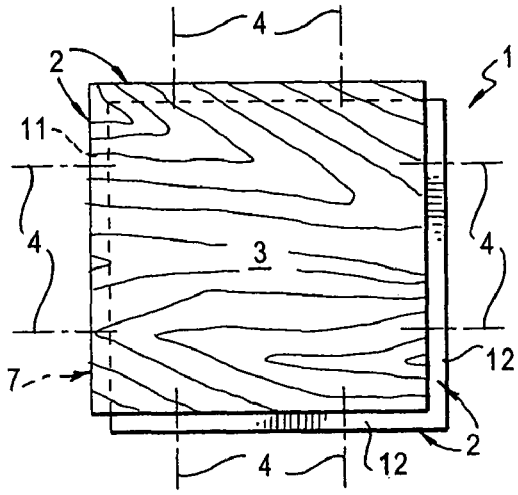
FIG. 1*a* shows, seen from above, an embodiment of a floor element 1 with a quadratic surface.
Figure 1B:
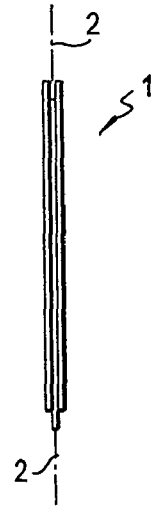
FIG. 1*b* shows the embodiment from FIG. 1*a* showed from the side.

Accordingly, FIG. 1*a* shows, seen from above, an embodiment of a floor element 1 with a quadratic or square surface, while FIG. 1*b* shows the embodiment from FIG. 1 as seen from the side. The floor element 1 is provided with edges 2, a lower side 7 and a decorative upper layer 3. The floor element 1 is also provided with groove 11 and tongue 12. The floor element 1 is, preferably, in all edges 2 provided with holes 4, which holes typically extend inwards from the edge 2 mainly parallel to the upper decorative layer 3. The holes 4 are intended to receive each one part of a guiding means 6 (FIG. 12). The holes 4 extend parallel to the edge 2 which is closest adjacent to the edge 2 where the holes 4 are arranged. The floor elements 1 are on each edge 2 provided with each one hole group of two holes 3. The holes have, in each hole group, been arranged on a mutual distance of N. The distance between each hole 4 and its closest corner between two adjacent edges is N/2. the length of the edge is hereby 2N.

Figure 2:
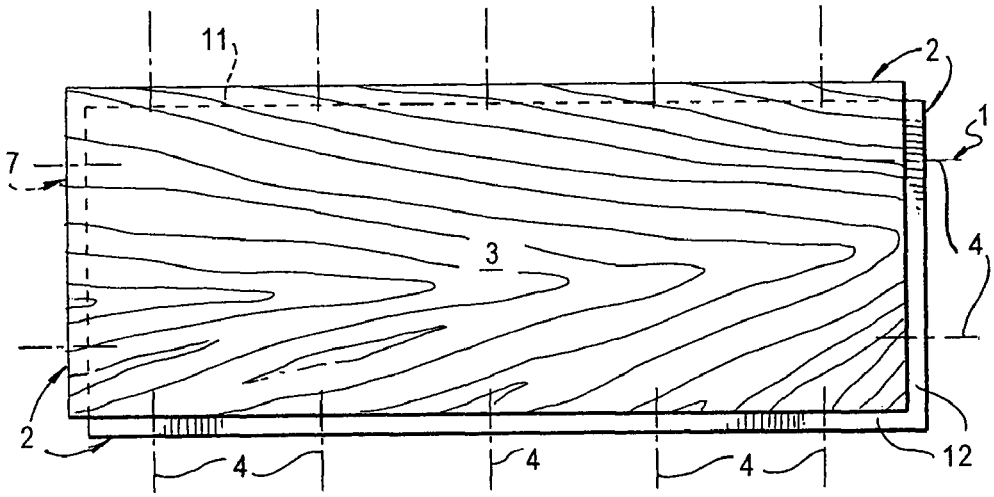
FIG. 2 shows, seen from above, a second embodiment of a floor element 1 with a rectangular surface.

FIG. 2 shows, seen from above, a second embodiment of a floor element 1 with a rectangular surface. The floor element 1 is provided with edges 2, a lower side 7 and a decorative upper layer 3. The floor element 1 is also provided with groove 11 and tongue 12. The floor element 1 is in all edges 2 provided with holes 4, which holes extend inwards from the edge 2, mainly parallel to the upper decorative surface 3. The holes 4 are intended to receive each one part of a guiding means 6 (FIG. 12). The holes 4 extend parallel to the edge 2 which is closest adjacent to the edge 2 where the holes 4 are arranged. The two shorter edges 2 are each provided with each one hole group of two holes 4, which holes have, in each hole group, been arranged on a mutual distance of N. The distance between each hole 4 and its closest corner between two adjacent edges is N/2. The length of the edge is hereby 2N. The two longer edges are provided with one hole group of five holes 4 each. The outermost holes has been arranged on a distance L/2 from its respective closest edge 2 while the distance between two adjacent holes 4, on the two longer edges 2, is L. The length of the longer edge 2 is thereby 5L. The length L is equal to the length N.

Figure 3:
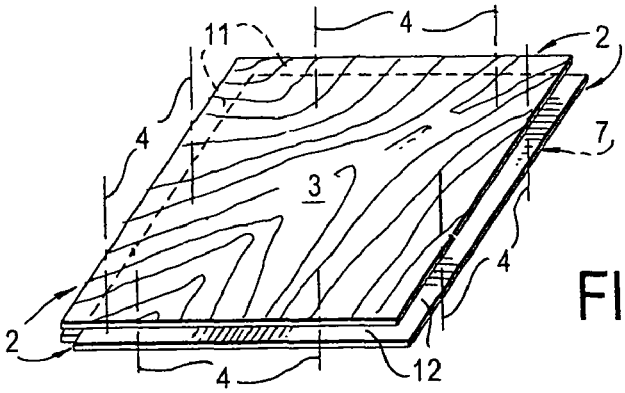
FIG. 3 shows, seen from above, yet another embodiment of a floor element 1 with a rhomboidal surface.

FIG. 3 shows, seen from above, yet another embodiment of a floor element 1 with rhomboidal surface. The floor element 1 is provided with edges 2, a lower side 7 and a decorative upper layer 3. The floor element 1 is also provided with groove 11 and tongue 12. The floor element 1 is in all edges 2 provided with holes 4, which holes extends inwards from the edge 2, mainly parallel to the upper decorative surface 3. The holes 4 are intended to receive each one part of a guiding means 6 (FIG. 12). The holes 4 extend parallel to the edge 2 which is closest adjacent to the edge 2 where the holes 4 are arranged.

According to an alternative embodiment the holes extend parallel to the edge 2 which is adjacent to the edge 2 where the holes 4 are arranged. This orientation of the holes 4 facilitates certain forms of design installations.

The floor element 1 may on all edges 2 be provided with each one hole group of two holes 4. The holes 4 have, in each hole group, been arranged on a mutual distance of N. The distance between each hole 4 and its closest corner between two adjacent edges is N/2. The length of the edge is hereby 2N.

FIG. 4 shows, seen from above, yet another embodiment of a floor element 1 with a hexagonal surface. The floor element 1 is provided with edges 2, a lower side 7 and a decorative upper layer 3. The floor element 1 is also provided with groove 11 and tongue 12. The floor element 1 is on all edges 2 provided with holes 4, which holes 4 extend inwards from the edge 2, mainly parallel to the upper decorative surface 3. The holes 4 are intended to receive each one part of a guiding means 6 (FIG. 12). The holes 4 extend parallel to the edge 2 which is closest adjacent to the edge 2 where the holes 4 are arranged. The floor element 1 is on all edges 2 provided with each one hole group of two holes 4. The holes 4 have, in each hole group, been arranged on a mutual distance of N. The distance between each hole 4 and its closest corner between two adjacent edges is N/2. The length of the edge is hereby 2N.

FIG. 5 shows, seen from above, yet another embodiment of a floor element 1 with rectangular surface. The floor element 1 is provided with edges 2, a lower side 7 and a decorative upper layer 3. The floor element 1 is also provided with groove 11 and tongue 12. The floor element 1 is in all edges 2 provided with holes 4, which holes extend inwards from the edge 2, mainly parallel to the upper decorative surface 3. The holes 4 are intended to receive each one part of a guiding means 6 (FIG. 12). The holes 4 extends perpendicular to the edge 2 where the holes 4 are arranged. The holes 4 furthermore extend parallel to the edge 2 which is closest adjacent to the edge 2 where the holes 4 are arranged. The two longer edges 2 are provided with one hole group of eight holes 4 each. The outermost holes has been arranged on a distance L/2 from its respective closest edge 2 while the distance between two adjacent holes 4, on the two longer edges 2, is L and 3L respectively. The length of the longer edge 2 is thereby 12L. The length of the shorter edges 2 is 2L.

The floor element may also, as shown in FIG. 2, be provided with holes 4 on the two shorter edges 2. These edges 2 are then provided with one hole group of two holes 4 each. The holes 4 are then arranged with a mutual distance of L. The distance between each hole 4 and its closest corner between two edges 2 are L/2.

The length of the edge 2 is as before 2L.

FIG. 6 shows, seen from above, an embodiment of the invention where quadratic floor elements 1 according to FIG. 1 and rectangular floor elements 1 according to FIG. 5 together form a designed installation. Tongue 12 and groove 11 is for the matter of clarity not shown. The quadratic floor elements 1 correspond completely to the one shown in FIG. 1. The rectangular floor elements 1 correspond mainly with the one shown in FIG. 5, the two shorter edges are however provided with holes 4 which correspond to the edges 2 of the quadratic floor element 1. The installation can accordingly be initiated by joining five quadratic floor elements 1 by means of one or two guiding means 6 (FIG. 12) per floor element so that a rectangular unit is formed. This may then be joined with a rectangular floor element 1 by means of one or more guiding means so that a part corresponding to 2L of the longer edge on the floor element 1 is left free. The quadratic floor elements 1 may alternatively be joined directly with the rectangular floor element 1 without first having to be joined with each other.

Another rectangular floor element 1 is then joined at an angle, with the already joined floor elements 1. One or more guiding means are used also here for the positioning of the floor elements 1. Further quadratic floor elements 1 are added to the already installed floor elements 1 until a square consisting of twenty-five quadratic floor elements 1 is formed. Another two rectangular floor elements 1 are then assembled at an angle so that the four rectangular floor elements 1 together forms a frame around the quadratic floor elements 1. Guiding means 6 are foremost used for the positioning the rectangular floor elements 1 to each other as they give the main shape of the installation pattern. Guiding means 6 should however be used on at least every first row of quadratic floor elements 1. The arrows illustrates how further floor elements 1 are joined with the previously installed.

A floor element 1 most often includes a core covered with an upper decorative layer 3. The core is most often comprised by wood particles or wood fibre bonded with resin or glue. It is advantageous to surface treat the area around the joint if the floor is to be exposed to moisture since the wood of the core is sensitive to moisture. This surface treatment may suitably include resin, wax or some kind of lacquer. It is not necessary to surface treat the joint if it is to be glued as the glue itself will protect the core from moisture penetration. The decorative upper layer 3 is constituted by a decorative paper impregnated with melamine formaldehyde resin. One or more layers of so-called overlay paper of α-cellulose which is impregnated melamine formaldehyde resin may possibly be placed on top of this.

One or a few of these layers may be sprinkled with hard particles of a aluminium oxide, silicon carbide or silicon oxide during the impregnation in order to improve the abrasion resistance. The lower side 7 may suitably be surface treated with lacquer or a layer of paper and resin.

Figure 7:
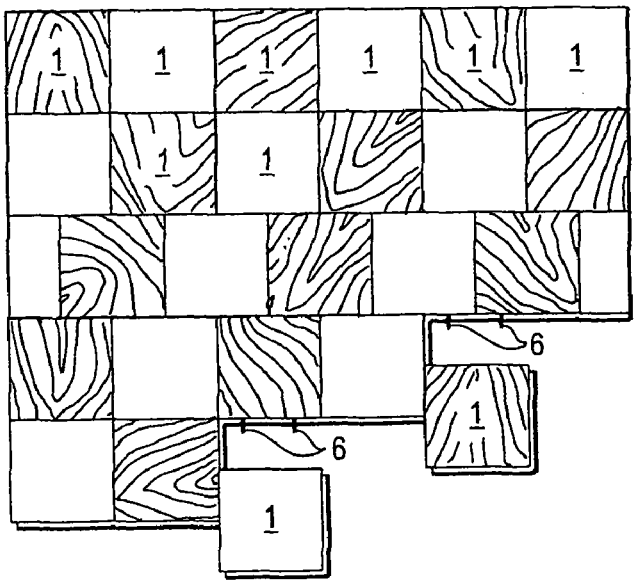
FIG. 7 shows, seen from above, an embodiment of the invention where quadratic floor elements from FIG. 1 form a so-called designed installation.

FIG. 7 shows, seen from above, an embodiment of the invention where quadratic floor elements 1 according to FIG. 1 form a so-called designed installation. The quadratic floor elements 1 correspond completely with the ones shown in FIG. 1. The installation can accordingly be initiated by joining quadratic floor elements 1 by means of one or two guiding means 6 (FIG. 12) per floor element 1 so that a unit is formed. The floor elements 1 can be joined so that both longitudinal and latitudinal joints coincides or so that the longitudinal and latitudinal joints are displaced by 1 N, i.e., half of the floor element edge. Guiding means 6 are foremost used for positioning the rows towards another so that the latitudinal joints coincides over the whole floor without forming curves. It is not necessary to use guiding means 6 on every floor element 1. Guiding means 6 should, however, at least be used when joining the outer rows of quadratic floor elements 1.

Figure 8:
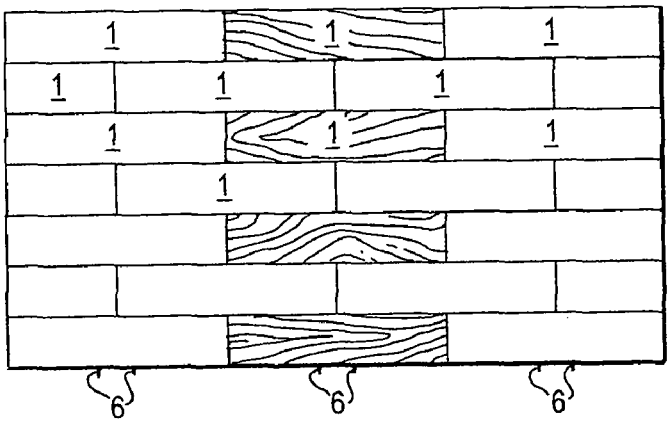
FIG. 8 shows, seen from above, an embodiment of the invention where rectangular floor elements according to FIG. 2 form a so-called designed installation.

FIG. 8 shows, seen from above, an embodiment of the invention where rectangular floor elements according to FIG. 2 form a so-called designed installation. The groove 11 and tongue is for the sake of clarity not shown. The rectangular floor elements 1 correspond completely with the one shown in FIG. 2. The installation can accordingly be initiated by joining two or more floor elements to a row by means of on or more guiding means 6 (FIG. 12) per floor element 1 so that a unit is formed. Further rows are then added to this first row. At least one guiding means 6 per row is used. These should be placed closest to the most visible pattern, which in the FIG. 8 is illustrated by a number of darker boards, comparable to a crosswalk, if only a few guiding means 6 is used. It is however advantageous to use a full set of guiding means 6 when installing at least the first row of floor elements 1.

Figure 9:
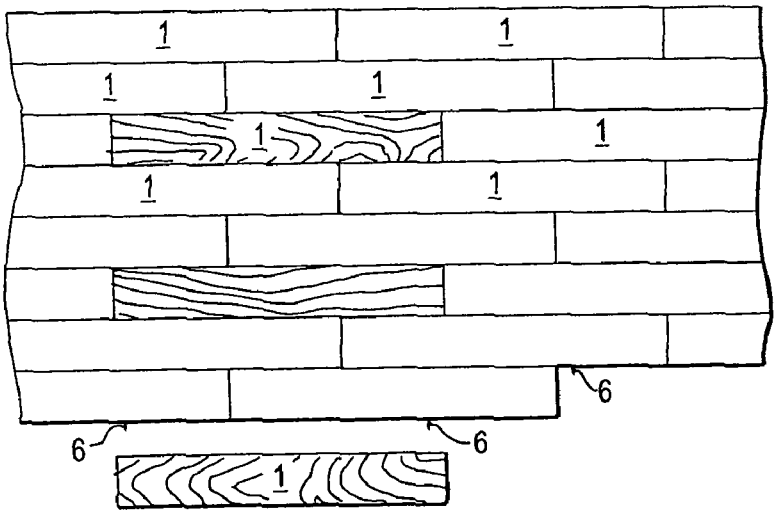
FIG. 9 shows, seen from above an embodiment of the invention where rectangular floor elements according to FIG. 5 form a so-called designed installation.

FIG. 9 shows, seen from above, an embodiment of the invention where rectangular floor elements 1 according to FIG. 5 form a so-called designed installation. The groove 11 and tongue is for the sake of clarity not shown. The installation corresponds in the main with the one illustrated in FIG. 8. The floor is however installed so that the latitudinal joints coincides over every third row.

The arrow illustrates how next design carrying floor element 1 is joined with the previously installed ones.

FIG. 10 shows, seen from above, an embodiment of the invention where rhomboidal floor elements according to FIG. 3 forms a more advanced designed installation. The holes 4 (FIG. 3) are however arranged parallel to the edge 2 which is closest to the edge 2 where the holes 4 are arranged. The groove 11 and tongue is for the sake of clarity not shown. Six rhomboidal floor elements 1 with a dark design are assembled by means of guiding means 6 so that the shape of a six-pointed star is formed. a number of rhomboidal floor elements 1 with a lighter design may then be joined around the already installed floor elements 1 by means of guiding means 6. Arrows illustrate how further floor elements 1 are joined with the already installed ones.

FIG. 11 shows further, seen from above, an embodiment of the invention where rhomboidal floor elements 1 according to FIG. 2 and hexagonal floor elements according to FIG. 4 together form an advanced designed installation. The holes 4 (FIG. 3) of the rhomboidal floor elements 1 are however arranged parallel to the edge 2 which is closest to the edge 2 where the holes 4 are arranged. The groove 11 and tongue is for the sake of clarity not shown. The floor elements 1 are gradually joined by means of guiding means 6. Arrows illustrate how further floor elements 1 are joined with the previously installed.

FIG. 12 shows, in cross-section, parts of two floor elements 1 and one guiding means 6 according to one embodiment of the invention. The floor elements 1 are provided with edges 2, a lower side 7 and a decorative upper layer 3. The floor elements 1 are intended to be joined by means of tongue 12 and groove 11. The floor elements 1 are at their edges 2 provided with holes 4, which holes 4 extend inwards from the edge 2 mainly parallel with the decorative upper layer 3. The holes are arranged on a predetermined distance from the decorative upper layer 3 and on a predetermined distance from the closest corner (FIG. 1) between two adjacent edges 2. The holes 4 are intended to each receive one part of a guiding means 6.

Figure 13:
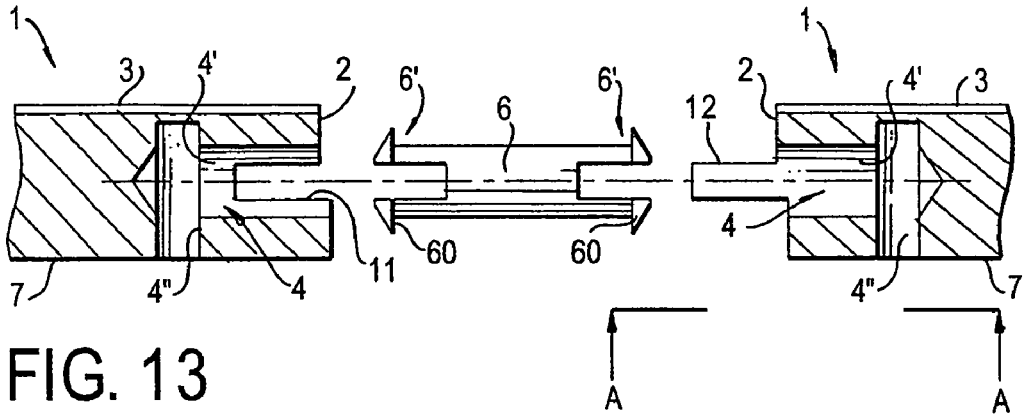
FIG. 13 shows, in cross-section, parts of two floor elements 1 and a guiding means 6 according to a second embodiment of the invention.

FIG. 13 shows, in cross-section, parts of two floor elements 1 and one guiding means 6 according to another embodiment of the invention. The floor elements 1 are provided with edges 2, a lower side 7 and a decorative upper layer 3. The floor elements 1 are intended to be joined by means of tongue 12 and groove 11. The floor elements 1 are at their edges 2 provided with holes 4, which holes 4 extend inwards from the edge 2 mainly parallel with the decorative upper layer 3. The holes are arranged on a predetermined distance from the decorative upper layer 3 and on a predetermined distance from the closest corner (FIG. 1) between two adjacent edges 2. The holes 4 are intended to each receive one part of a guiding means 6. The holes 4 are provided with an inner gripping edge 4' which is achieved by milling a groove 4" from the lower side 7. See also FIG. 15. The groove 4" is perpendicular to the hole 4 and thereby parallel to the edge 2 where the hole 4, which is intersected by the groove 4", is arranged. The guiding means 6 is provided with two ends 6' each, which each are provided several resilient protrusions 60 which are intended to interact with gripping edges 4' of the holes 4 during assembly.

Figure 14:
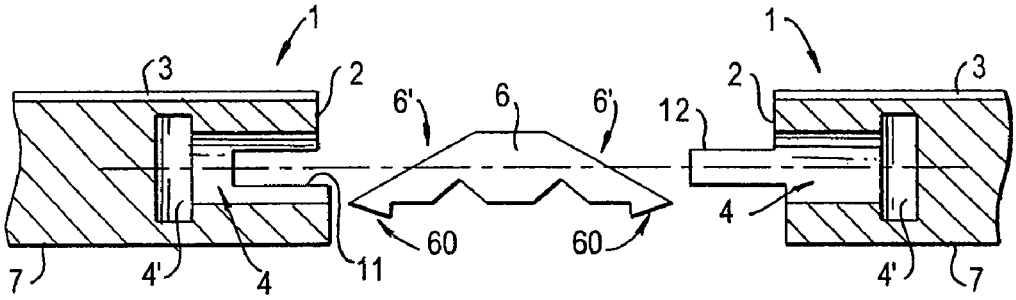
FIG. 14 shows, in cross-section, parts of two floor elements 1 and a guiding means 6 according to yet another embodiment of the invention.

FIG. 14 shows, in cross-section, parts of two floor elements 1 and one guiding means 6 according to yet another embodiment of the invention. The floor elements 1 are provided with edges 2, a lower side 7 and a decorative upper layer 3. The floor elements 1 are intended to be joined by means of tongue 12 and groove 11.

The floor elements 1 are at their edges 2 provided with holes 4, which holes 4 extend inwards from the edge 2 mainly parallel with the decorative upper layer 3.

The holes are arranged on a predetermined distance from the decorative upper layer 3 and on a predetermined distance from the closest corner (FIG. 1) between two adjacent edges 2. The holes 4 are intended to each receive one part of a guiding means 6. The holes 4 are provided with an inner gripping edge 4' which is achieved by milling a step with larger diameter than the holes 4 on a predetermined depth after the drilling. The guiding means 6 is provided with two ends 6' each, which each are provided several resilient protrusions 60 which are intended to interact with gripping edges 4' of the holes 4 during assembly.

Figure 15:
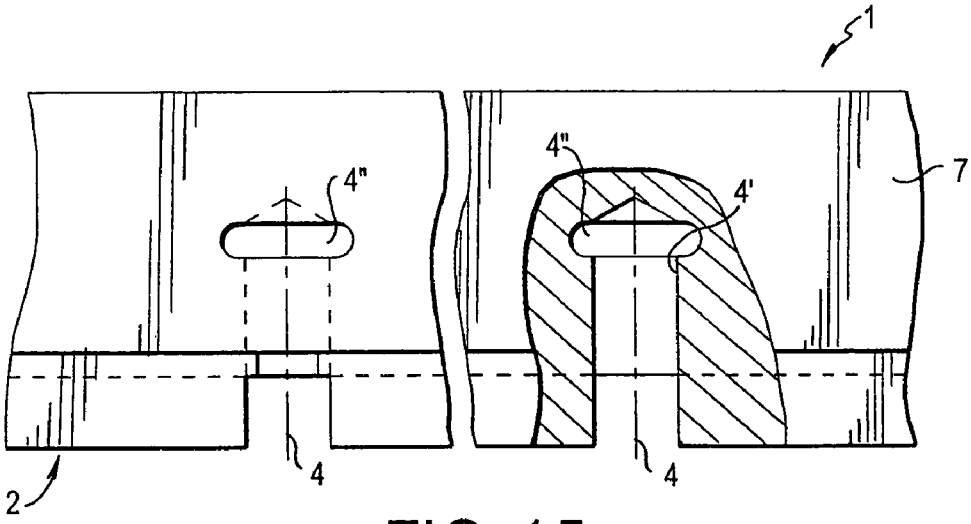
FIG. 15 shows, seen from below, parts of the floor element 1 showed in FIG. 13.

FIG. 15 shows, seen from below, parts of the floor element 1 shown in FIG. 13.

The holes 4 are provided with an inner gripping edge 4' which is achieved by milling a groove 4" from the lower side 7. See also FIG. 13. The groove 4" is perpendicular to the hole 4 and thereby parallel to the edge 2 where the hole 4, which is intersected by the groove 4", is arranged.

The invention is not limited by the embodiments shown, since these can be varied in different ways within the scope of the invention. It is for example most advantageous to use glue when the floor elements 1 are to be joined even when embodiments with holes 4 having gripping edges 4' and guiding means with resilient protrusions 70 are used. These are foremost used for positioning the floor elements 1 so that gaps can be avoided and that a designed installation can be achieved by the one not skilled in the art without any need of special tools.

Floor elements 1 most often also includes a core covered with an upper decorative layer 3. The core is most often comprised by wood particles or wood fibre bonded with resin or glue. It is advantageous to surface treat the area around the joint if the floor is to be exposed to moisture since the wood of the core is sensitive to moisture. This surface treatment may suitably include resin, wax or some kind of lacquer. It is not necessary to surface treat the joint if it is to be glued as the glue itself will protect the core from moisture penetration. The decorative upper layer 3 is constituted by a decorative paper impregnated with melamine formaldehyde resin. One or more layers of so-called overlay paper of a-cellulose which is impregnated melamine formaldehyde resin may possibly be placed on top of this. One or a few of these layers may be sprinkled with hard particles of a-aluminium oxide, silicon carbide or silicon oxide during the impregnation in order to improve the abrasion resistance. The lower side 7 may suitably be surface treated with lacquer or a layer of paper and resin.

FIGS. 16-19 are illustrative of various ways to assemble the panels according to the invention. In each of these Figs. A and B represent two panels assembled in a first row, C represents a first panel assembled in a second row and D represents a new panel to be assembled so as to adjoin said first and second rows. All of such new panels D are assembled by horizontally pushing the new panel D in one of the following steps.

In FIG. 16, new panel D is engaged at its "short side" 401 with a short side 402 of panel C and is horizontally pushed in the direction of arrow 501 so as to slide along the short side 402 of panel C with panel D's respective locking means, for example, upper and lower snapping webs, are received in the respective upper and lower snapping grooves of panel C and until the "long sides" 403 of panel D engages with the edges 404, 405 of panels A and B.

In the alternative installation method of FIG. 17, new panel D is engaged at its long side 403 with the long side 405 of panel B and horizontally moved along arrow 602 until panel D's short side 401 engages with short side 402 of panel C. The horizontal motion does not require that any of the panels be "tilted" or "angled" out of the plane of the paper in order to joint the new panel D with any of the previously laid panels A-C.

Still further, new panel D may be simultaneously assembled with short side 402 of panel C and the long sides 404 and 405 of panels A and B by exerting a force in the direction of arrow 202 as shown in FIG. 18. In one preferred embodiment, a special tapping block (not shown) configured to engage with the tongue and groove segments of new panel D can be used to horizontal urge panel D into simultaneous engagement with each of panels A, B, and C.

FIG. 19 shows a "double" horizontal push method of assembling a new panel into engagement with previously laid panels. In this embodiment, new panel D is placed with its long side 403 at a distance (for instance, 2 cm) from the long sides 404 and 405 of panels A and B, respectively. Then the new panel D is pushed horizontally in the direction of arrow "a" until the short side of 401 of panel D snaps together with the short side 402 of panel C. Then, panel D is pushed horizontally in the direction of arrow "b" (while still engaged with panel C along the joint formed by short side 402 of panel C and short side 401 of panel D) until the side 403 of panel D snaps together with the long sides 404 and 405 of panels A and B, respectively.

Thus, we have disclosed not only a configuration of making panels having unique tongue and groove configurations which permit "glueless" assembly of the panels by a click system, but also a method of assembling such panels into a finished structure, such as a floor.

I claim:

1. A method for forming a surface comprising:

assembling a plurality of panels to form a first row of panels with the panels in the first row being assembled edge to edge; each of said panels having an upper surface, which when assembled with at least one adjacent panel forms part of said surface; at least one edge of each of the panels having a portion comprising at least one of a tongue and a groove;

attaching a first panel in a second row to at least two panels in said first row, such that an edge of said first panel is mated with at least two panels of the first row through a tongue and groove joint and engaging locking elements to lock said first and said at least two panels to each other;

relatively sliding a new panel in a horizontal direction into position in said second row, such that an edge of said second panel is mated by a tongue and groove joint with at least one panel of the first row and locking the new panel to at least one panel of the first row by engaging locking elements;

moving by horizontal motion said new panel toward said first panel of the second row to join an edge of said first panel to an edge of said new panel while said new panel remains locked to said at least one panel of the first row.

2. The method of claim 1, wherein said panels of said first row of panels comprise opposing long sides and opposing short sides, whereby said new panel is slid along one of said long sides of a panel of said first row.

3. The method of claim 1, wherein said first panel of said second row comprises opposing long sides and opposing short sides, whereby said attaching step comprises attaching one of said long sides of said first panel to at least one panel of said first row.

4. The method of claim 1, wherein said new panel comprises opposing long sides and opposing short sides, whereby one of said long sides is mated with at least one panel of said first row.

5. The method of claim 4, wherein said first panel of said second row comprises opposing long sides and opposing short sides, whereby said attaching step comprises attaching one of said long sides of said first panel to at least one panel of said first row.

6. The method of claim 1, wherein said joined edge comprises locking elements.

7. The method of claim 1, whereby said relative sliding step and said moving step are performed simultaneously.

8. The method of claim 1, whereby said relative sliding step is performed before said moving step.

9. A floor formed by the method of claim 1.

10. The method according to claim 1 wherein the locking elements are elements separate from the panels, and the method further comprises inserting the locking elements into holes in the panels.

11. The method according to claim 10 wherein the locking elements comprise resilient protrusions.

12. The method according to claim 11 further comprising resilient protrusions interacting with gripping edges on holes in the panels.

13. A method for forming a surface comprising:

assembling a plurality of panels to form a first row of panels with the panels in the first row being assembled edge to edge; each of said panels having an upper surface, which when assembled with at least one adjacent panel forms part of said surface;

attaching a first panel in a second row to at least two panels in said first row by tongue and groove elements, such that an edge of said first panel is mated with at least two panels of the first row and engaging guiding elements to lock the panels together;

relatively sliding a new panel in a horizontal direction into position in said second row, such that an edge of said second panel is mated with at least one panel of the first row by tongue and groove elements;

moving by horizontal motion said new panel toward said first panel of the second row to join an edge of said first panel to an edge of said new panel.

* * * * *